US010278552B2

(12) United States Patent
Ma et al.

(10) Patent No.: US 10,278,552 B2
(45) Date of Patent: May 7, 2019

(54) DISINFECTING WIPES FLEX PACK CLOSURE

(71) Applicant: THE CLOROX COMPANY, Oakland, CA (US)

(72) Inventors: Benjamin Ma, Pleasanton, CA (US); John D. English, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 127 days.

(21) Appl. No.: 15/373,319

(22) Filed: Dec. 8, 2016

(65) Prior Publication Data

US 2018/0160868 A1 Jun. 14, 2018

(51) Int. Cl.

| | |
|---|---|
| ***B08B 3/04*** | (2006.01) |
| ***A47K 10/42*** | (2006.01) |
| ***B08B 1/00*** | (2006.01) |
| ***B65D 43/16*** | (2006.01) |
| ***B65D 77/20*** | (2006.01) |
| ***B65D 77/38*** | (2006.01) |
| ***B65D 83/08*** | (2006.01) |
| ***B65D 75/58*** | (2006.01) |

(52) U.S. Cl.

CPC ..... *A47K 10/421* (2013.01); *B08B 1/006* (2013.01); *B08B 3/04* (2013.01); *B65D 43/16* (2013.01); *B65D 75/5877* (2013.01); *B65D 75/5894* (2013.01); *B65D 77/20* (2013.01); *B65D 77/38* (2013.01); *B65D 83/0805* (2013.01); *B65D 2577/205* (2013.01)

(58) Field of Classification Search

CPC ..... A47D 10/421; B08B 1/006; B08B 3/04; B65D 43/16; B65D 77/20; B65D 77/38; B65D 83/0805

See application file for complete search history.

(56) References Cited

U.S. PATENT DOCUMENTS 4,848,575 A * 7/1989 Nakamura ..... B65D 83/0805 206/449

5,582,294 A 12/1996 Yamada (Continued)

FOREIGN PATENT DOCUMENTS

WO D072767002 12/2009
WO D0629309 12/2010

(Continued)

*Primary Examiner* — Patrick H Mackey
(74) *Attorney, Agent, or Firm* — Alok Goel

(57) ABSTRACT

The present invention is directed to a flex pack wipes dispensers for dispensing wipes. An exemplary wipes dispenser may include a flexible container body having an opening through which the wipes are dispensed. A plurality of wipes (e.g., a stack) is contained in the flexible container body. A closure is provided over the opening through the flexible container body, configured to allow a user to selectively open and close access to the opening. The closure may include a perimeter flange sealed to the flexible container body, a base defined within the flange which initially covers the opening in the flexible container body, and a tear-away orifice covering in the base. A shape of the covering includes a perimeter following a pathway that includes a portion forming an angle that is greater than 90° relative to a direction of pull used to tear the covering from the base.

10 Claims, 12 Drawing Sheets

(56) References Cited

U.S. PATENT DOCUMENTS 5,704,471 A * 1/1998 Yamada ..... B65D 75/58 206/207
D446,452 S 8/2001 Buck et al.
6,309,105 B1 * 10/2001 Palumbo ..... B65D 75/5838 206/494
7,143,906 B2 * 12/2006 Chasid ..... B65D 83/0805 221/45
7,530,472 B2 5/2009 Bitowft et al.
7,600,641 B2 10/2009 Burgess
7,665,629 B2 * 2/2010 Julius ..... A47K 10/421 221/302
7,703,602 B2 4/2010 Saito et al.
D629,309 S 12/2010 Stewart
D665,259 S 8/2012 Dunn
D703,534 S 4/2014 Yamada
D703,535 S 4/2014 Yamada
D710,197 S 8/2014 Yamada
D712,751 S 9/2014 Bechyne et al.
D730,182 S 5/2015 Leung et al.
9,067,724 B2 6/2015 Yamada
9,399,540 B2 * 7/2016 Bushman ..... B65D 75/5833
9,463,896 B2 * 10/2016 Fitzwater ..... B65D 5/5425
9,491,932 B1 * 11/2016 Becattini, Jr. ..... A01K 27/008
9,796,520 B2 * 10/2017 Ishihara ..... B65D 75/5838
2005/0189367 A1 * 9/2005 Chasid ..... B65D 75/5838 221/35
2005/0258062 A1 11/2005 Bando
2006/0151515 A1 * 7/2006 Hood ..... B65D 83/0805 221/29
2008/0253697 A1 * 10/2008 O'Neill ..... B65D 75/5838 222/92
2010/0300915 A1 12/2010 Kakura
2011/0147401 A1 * 6/2011 Rubo ..... B65D 75/5838 221/1
2012/0223093 A1 * 9/2012 Hallam ..... B65D 77/042 221/46
2013/0240556 A1 9/2013 Yamada
2014/0124402 A1 5/2014 Yamada
2014/0144803 A1 5/2014 Yamada
2014/0291343 A1 10/2014 Neitzel
2014/0374432 A1 12/2014 Bechyne et al.
2014/0374435 A1 12/2014 Thoresen et al.
2015/0008238 A1 * 1/2015 Yamada ..... A47K 10/421 221/63
2015/0102050 A1 4/2015 Marin-Quintero et al.
2015/0113749 A1 4/2015 Martini-Merlo et al.
2015/0196176 A1 * 7/2015 Felix ..... A47K 10/3618 221/46
2015/0230673 A1 8/2015 Goble
2015/0368026 A1 12/2015 Yamada
2016/0031632 A1 2/2016 Ripberger et al.
2016/0106273 A1 4/2016 Yamada
2016/0159534 A1 6/2016 Ujiie
2016/0374523 A1 * 12/2016 Santos ..... A47K 10/421 221/1
2017/0258279 A1 * 9/2017 Wahl ..... B65D 43/16
2017/0354299 A1 * 12/2017 Scholer ..... A47K 10/32

FOREIGN PATENT DOCUMENTS

WO D07487001 12/2010
WO D074847004 12/2010
WO D077020001 5/2012
WO 2014073334 A1 5/2014
WO 2014199409 A1 12/2014

* cited by examiner

DISINFECTING WIPES FLEX PACK CLOSURE

BACKGROUND OF THE INVENTION

1. The Field of the Invention

The present invention relates to packages or containers including a flexible (e.g., bag-like) body, with a hinged closure positioned over an opening in the flexible body through which wipes, tissues, or the like may be dispensed.

2. Description of Related Art

Wetted wipes including a cleaning formulation impregnated therein are employed in a wide variety of circumstances for disinfecting or cleaning various surfaces. Because the wipes are typically pre-wetted with a cleaning formulation, it is important that the container be sealed so as to prevent the wipes from prematurely drying out.

Such wipes may initially be interleaved with or otherwise attached to one another, by which they may in theory be easily separated from one another, as a lead wipe may be separated from the following wipe as it is pulled from the container. In actual practice, with existing dispensing configurations, there is often a tendency for the lead wipe to not fully separate from the following wipe as the lead wipe is pulled from the dispenser, leading to more than the single desired wipe being pulled through the orifice (referred to as "roping"). Such roping leads to waste, as more wipes than the user intended end up being dispensed from the container.

Similarly, often even if separation of the lead wipe does occur from the subsequent wipe, the subsequent wipe is pulled sufficiently from the package that it becomes difficult to close the hinged closure so that the consumer must manipulate the retained wipe out of the way of the closure mechanism, to achieve a good seal.

Another issue with existing configurations is the tendency for the lead wipe to fall back into the container, requiring the user to retrieve the lead wipe and rethread it through the orifice and/or any retention mechanism associated with the orifice (referred to as "fallback"). As a result, there continues to be a need for improved wipe dispenser configurations that may alleviate one or more of these or other issues.

BRIEF SUMMARY

In an embodiment, the present invention is directed to a wipes dispenser (e.g., a package of wipes) including a flexible container comprising a flexible container body (e.g., a thin film plastic packaging) having an opening through which wipes may be dispensed. The flexible container body defines an interior region containing a plurality of wipes (e.g., configured as a rectangular stack of wipes) that may be interfolded, interleaved, or otherwise interconnected such that pulling on a lead end of a lead wipe of the plurality of wipes causes a following wipe to also be pulled and follow the lead wipe. The wipes dispenser further includes a closure positioned over the opening of the flexible container body which is configured to allow a user to selectively open and close access to the opening. The closure may include a perimeter flange which is sealed to the flexible container body, a base defined within the perimeter flange which initially covers the opening through the flexible container body, and a tear-away orifice covering (e.g., a frangible portion of the base) that is defined in the base of the closure. A shape of the tear-away orifice covering includes a tear-away perimeter that follows a pathway that forms an angle that is greater than 90° relative to a direction of pull as the tear-away orifice covering is torn away from the base. In other words, as the tear-away covering is pulled away, there is a point in the progression of the removal of the covering where the direction that the orifice is expanding in actually moves backwards (i.e., greater than 90°), towards where the tear-away covering initially began to be peeled away.

Another embodiment is directed to a wipes dispenser including a flexible container comprising a flexible container body (e.g., a flexible package of wipes) having an opening through the flexible container body through which wipes may be dispensed. The flexible container body defines an interior region containing a plurality of wipes (e.g., in a rectangular stack configuration). The plurality of wipes may be interfolded, interleaved, or otherwise interconnected such that pulling on a lead end of a lead wipe of the plurality of wipes causes a following wipe to also be pulled and follow the lead wipe. A closure is provided over the opening of the flexible container body which is configured to allow a user to selectively open and close access to the opening. The closure includes a perimeter flange which is sealed to the flexible container body, a base defined within the perimeter flange which initially covers the opening through the flexible container body, and a tear away orifice covering defined in the base of the closure. The tear-away orifice covering is in a particular shape that follows a pathway forming an angle that is greater than 90° (at at least some point) relative to a direction of pull as the tear-away covering is torn away from the base. A hinged cover may be provided, selectively closeable over the base of the closure. The entire closure (e.g., the hinged cover, the perimeter flange, and the base with its tear-away orifice covering) may be formed as a single piece of material (e.g., injection molded as a single, integral piece of material). No additional structures may be interposed between the single piece closure and the plurality of wipes in the flexible container body. For example, no separate orifice defining member in addition to the orifice of the single piece closure may be disposed between the wipes and the closure as the wipes are pulled through the opening in the flexible container body. This is advantageous over embodiments that employ a multi-piece closure, where a separate piece defining the orifice is provided, which separate pieces require assembly. Rather, in the present embodiments, the wipes are pulled through the opening in the film material of the flexible body container, and through an orifice that is provided by the single piece injection molded closure.

Another embodiment relates to a method of use (e.g., for opening a wipes dispenser and dispensing wipes therefrom). Such a method may include providing a wipes dispenser such as those described herein, and pulling a pull-tab associated with the tear-away orifice covering defined in the base of the closure of the wipes dispenser. The tear away perimeter may follow a pathway that extends backwards, at an angle greater than 90°, towards an initial location of the pull-tab, during at least a portion of the period as the tear-away orifice covering is torn away from the base, so as to create an orifice in the base having the shape of the tear-away orifice covering. Once the orifice has been created by removal of the tear-away covering, a lead wipe from the plurality of wipes can be pulled through the orifice in the closure. The particular orifice geometries disclosed herein, including an angle of greater than 90° relative to the direction of pull, have been found to advantageously decrease or resist roping of wipes, and/or to decrease or resist fallback of the following wipe back through the orifice. The presently described embodiments present an improvement over existing orifice configurations, better striking the desired delicate balance between reducing roping (leading to waste as more than one wipe at a time is dispensed) and reducing fallbacks (which is frustrating, as it requires the user to again separate the leading edge of the lead wipe in preparation to pulling it from the dispenser).

What is ideally desired is that upon pulling the lead wipe from the dispenser, that only the lead wipe be dispensed, and that the following wipe (which becomes the next lead wipe) thread itself through the orifice in a manner that the leading end thereof is separated from the remainder of the wipe, poised for easy dispensing the next time a wipe is wanted, where the threaded wipe does not occlude closing of a hinged cover over the wipe threaded through the orifice.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
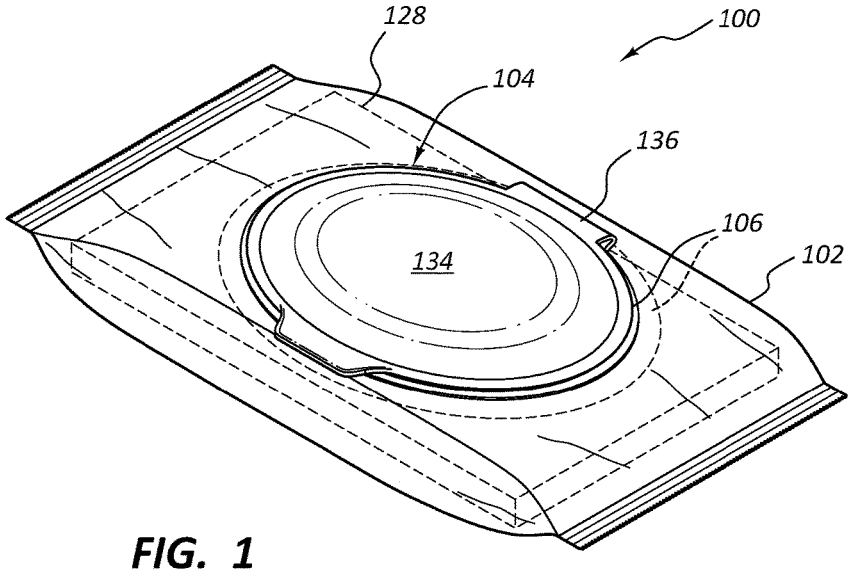
FIG. 1 is a perspective view of an exemplary wipes dispenser configured as a flexible package according to the present invention.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

II. Introduction

The present invention is directed to wipes dispensers from which wipes may be dispensed one at a time as a lead wipe of a plurality of interconnected wipes is pulled from the flexible container or package (used interchangeably herein), becoming separated from the following wipe as it is dispensed. An exemplary wipes container may include a flexible container body having an opening through the flexible container body through which wipes are dispensed. The flexible container body may be formed of a thin, film polymeric material. The flexible container body defines an interior region containing a plurality of wipes (e.g., positioned therein as a rectangular stack of wipes) that are interconnected such that pulling on a lead end of a lead wipe of the plurality of wipes causes a following wipe to also be pulled and follow the lead wipe. By way of example, the plurality of wipes may be configured as a "pack" in which adjacent wipes are stacked, cross-folded, interfolded, interleaved, or otherwise interconnected so that pulling on a lead end of a lead wipe causes a following wipe to also be pulled and follow the lead wipe. Any desired configuration of stacking the wipes may be employed. Numerous such possible configurations will be apparent to those of skill in the art in light of the present disclosure. Non-limiting examples of such interconnected stacking of wipes are disclosed in U.S. Publication 2016/0031632, herein incorporated by reference in its entirety. Other possible configurations will be apparent to those of skill in the art.

The wipes dispenser further includes a closure (e.g., relatively rigid as compared to the thin film material of the flexible container body) positioned over the opening of the flexible container body, which closure is configured to allow a user to selectively open and close access to the opening. The closure thus seals the opening when closed, e.g., preventing the wipes from drying out (e.g., where they are pre-moistened with a desired treatment composition), and also preventing dirt and debris from entering the dispenser and contaminating the wipes. Such closure may include a perimeter flange which is sealed to the flexible container body, a base defined within the perimeter flange which initially covers the opening through the flexible container body, and a tear-away orifice covering defined in the base of the closure. The tear-away covering (e.g., a frangible member of the base) includes a shape including a tear-away perimeter that follows a pathway that forms an angle that is greater than 90° relative to a direction of pull employed as the tear-away covering is torn away from the base. The orifice forms as a result of the tear-away covering being torn away. A hinged cover may be provided as part of the closure, so as to selectively close over the orifice in the base (and opening through the flexible film material of the flexible container body thereunder).

III. Exemplary Wipes Dispensers

FIG. 1 shows an exemplary wipes dispenser 100 including a flexible container body 102 having an opening through which wipes may be dispensed. By way of example, flexible container body 102 may comprise a thin film polymeric material such as polypropylene, polyethylene, other polymers, or the like. Combinations of such materials may also be suitable for use. Such thin flexible polymeric materials may typically be less than 0.5 mm in thickness (e.g., less than 0.4 mm, less than 0.3 mm, from 0.01 mm to 0.3 mm, from 0.05 mm to 0.3 mm, or from 0.1 mm to 0.3 mm). In part because of their thinness, such materials are very flexible. In some embodiments, the flexible container body 102 may be in a generally rectangular shape, as apparent from FIG. 1, as opposed to a canister or plastic tub, which configurations are formed from relatively thicker materials, and while possibly exhibiting some flexibility, are not flexible to the degree as "flex packs" such as those illustrated in FIG. 1. Of course, while described principally in the context of such "flex packs", it will be appreciated that the closures described herein could conceivably be employed with canisters, plastic tubs, or other containers, in some embodiments.

Wipes dispenser 100 further includes a closure 104 positioned over the opening of the flexible container body 102, which is configured to allow a user to selectively open and close access to the opening. Closure 104 is illustrated as including a perimeter flange 106 which may be heat-sealed or otherwise sealed to flexible container body 102. As shown, for example, in FIGS. 3, 9*a* and 9*b*, the perimeter flange 106 includes a plurality of concentric walls 109*a*, 109*b*, and 109*c*. In the illustrated embodiment, flange 106 is sealed to an interior surface of the flexible container body 102, i.e., it is shown being disposed under the film material of flexible container body 102, e.g., being heat sealed, secured with an adhesive, or otherwise sealed thereto, to provide an air-tight and water-tight seal therebetween. Briefly referring to FIGS. 9*a* and 9*b* as well, it can be seen that an edge portion of the film material of the flexible container body 102 is positioned in an annular slot 107 defined by spaced-apart upper and lower portions of the perimeter flange 106.

Figure 2:
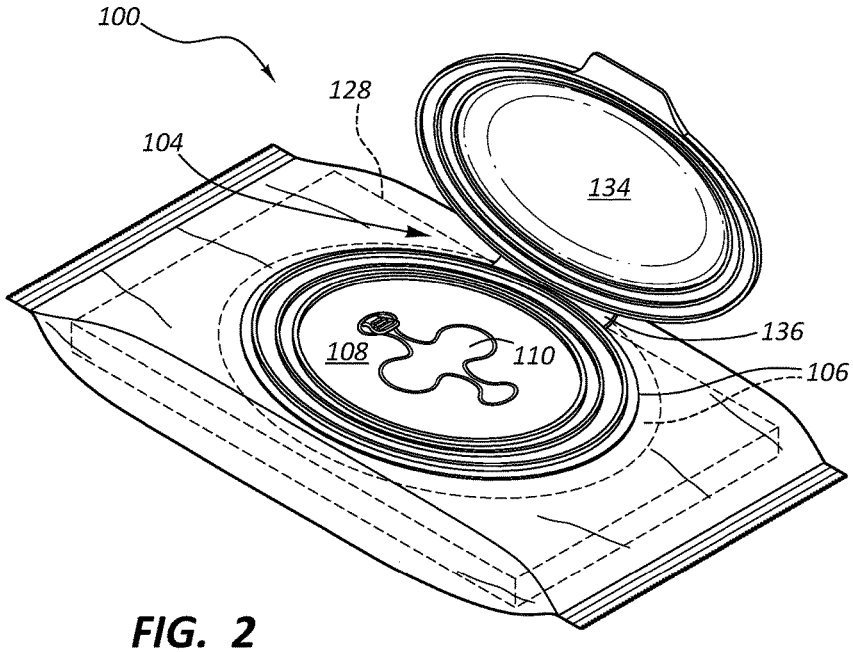
FIG. 2 is a perspective view similar to that of FIG. 1, with a hinged cover of the closure of the wipes dispenser opened, showing the base and tear-away orifice covering thereunder.
Figure 3:
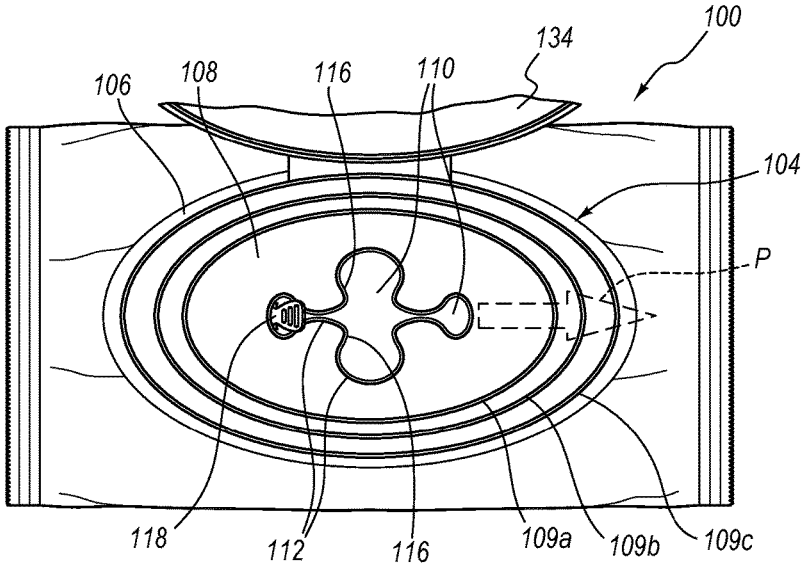
FIG. 3 is a top plan view of the base and tear-away orifice covering of FIG. 2, with the hinged cover not being shown.

As shown in FIG. 2, closure 104 includes a base 108 defined within perimeter flange 106. Base 108 initially covers the opening through flexible container body 102, through which the wipes will be dispensed. Closure 104 also includes a tear-away orifice covering 110 defined in base 108 of closure 104. Tear-away orifice covering 110 may be a frangible member of base 108 which is configured to be torn away from base 108 when it is desired to access the wipes within dispenser 100. As shown in FIG. 3, the tear-away orifice covering 110 is in a particular shape which includes a perimeter 112 that follows a pathway that forms an angle that is greater than 90° relative to a direction of pull (P) as the tear-away covering 110 is torn away from base 108. In other words, the shape of covering 110 (and the orifice 114 that results once covering 110 is torn away) includes at least one portion 116 that is angled (e.g., curved) backwards, towards point where removal of covering 110 begins (e.g., at tab 118). Portion 116 creates an angle θ greater than 90° relative to such direction of pull P. Enlarged FIGS. 8A-8B perhaps best illustrate this "backwards" greater than 90° angle.

As shown in FIGS. 2-3, a pull-tab 118 may be provided, attached to covering 110, providing a convenient location which may be gripped by the user as covering 110 is removed from base 108. For example, tab 118 may be configured as any member which extends from covering 110, so as to be easily gripped, such as a ring, or any other shaped extension from covering 110. Along with all the other portions of closure 104, pull-tab 118 may be integrally molded with the remainder of closure 104 as a single piece.

As shown in FIGS. 1-2, a cover 134 may be hingedly connected (e.g., hinge 136) to the remainder of closure 104. For example, in an embodiment hinge 136 may connect cover 134 to a portion of perimeter flange 106. Cover 134 may ensure a user can close the wipes dispenser 100 when not in use, e.g., to prevent wipes 128 within flexible container body 102 from drying out, and to prevent dirt, debris, or other unwanted material from entering through the orifice and contaminating wipes 128 once covering 110 has been removed.

Figure 8A:
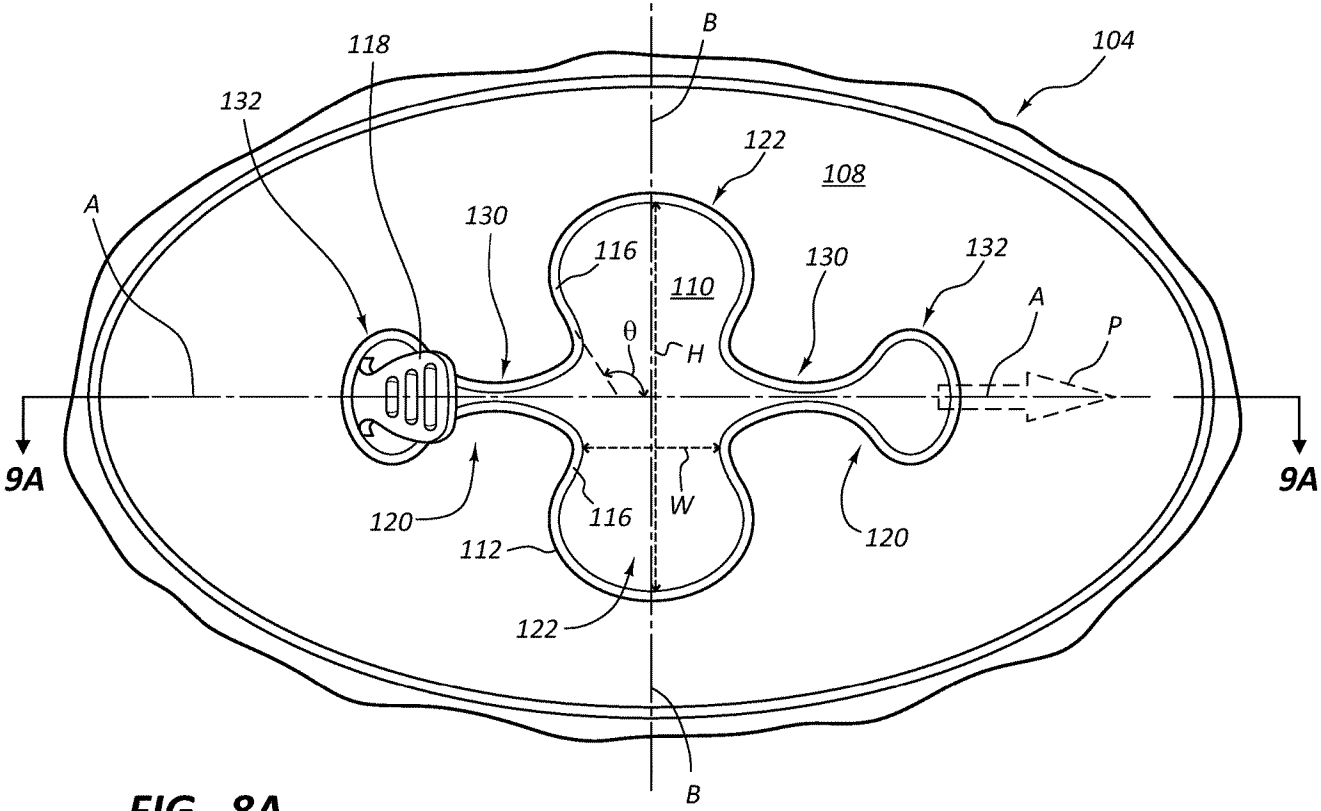
FIG. 8A illustrates an enlarged plan view of the base, the tear-away orifice covering, and the pull-tab of the closure shown in FIG. 1 other orifice geometries according to the present invention.
Figure 8B:
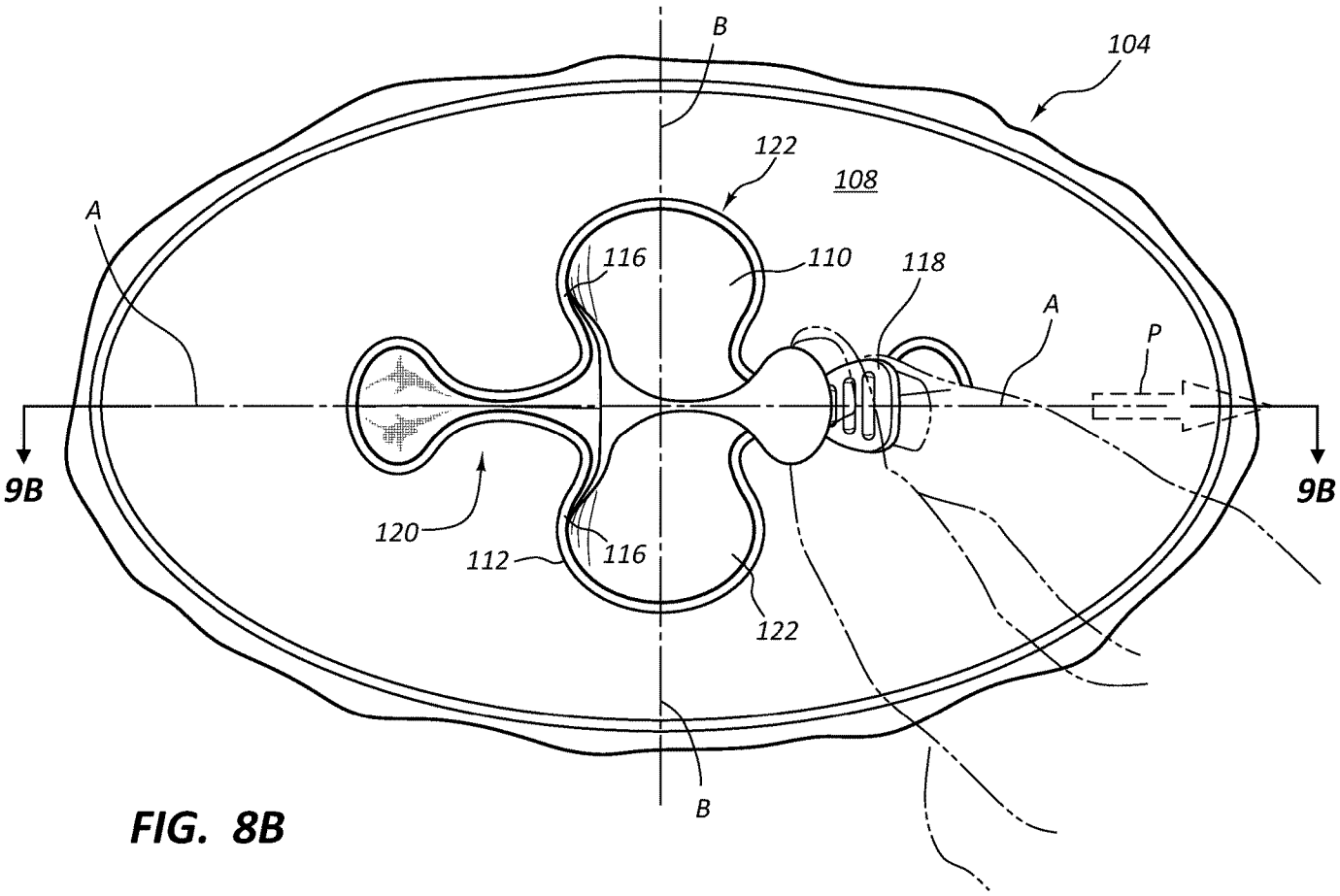
FIG. 8B is a view similar to that of FIG. 8A, in which the pull-tab is being pulled, beginning to remove the tear-away orifice covering, similar to FIG. 4.

FIGS. 3-5 and 8A-8B show an exemplary shape for covering 110 and the resulting orifice 114. FIGS. 8A-8B are enlarged, perhaps showing these features best. By way of example, orifice 114 and covering 110 may include proximal and distal narrowed portions 120, e.g., aligned along latitudinal axis A, and a central widened portion 122 centered along longitudinal axis B. In some embodiments, the shape of covering 110 and orifice 114 may be symmetrical, e.g., exhibiting symmetry along axis A, along axis B, or both. As apparent, the covering 110 and resulting orifice 114 may occupy only a relatively small fraction of the overall surface area of base 108 defined within closure 104. For example, elliptical base 108 may extend beyond orifice 114, such that orifice 114 and covering 110 only occupies no more than 50%, no more than 40%, no more than 35%, no more than 30%, no more than 25%, or even no more than 20% of the surface area of the recessed base 108 (e.g., the recessed ellipse within the center of closure 104).

Figure 4:
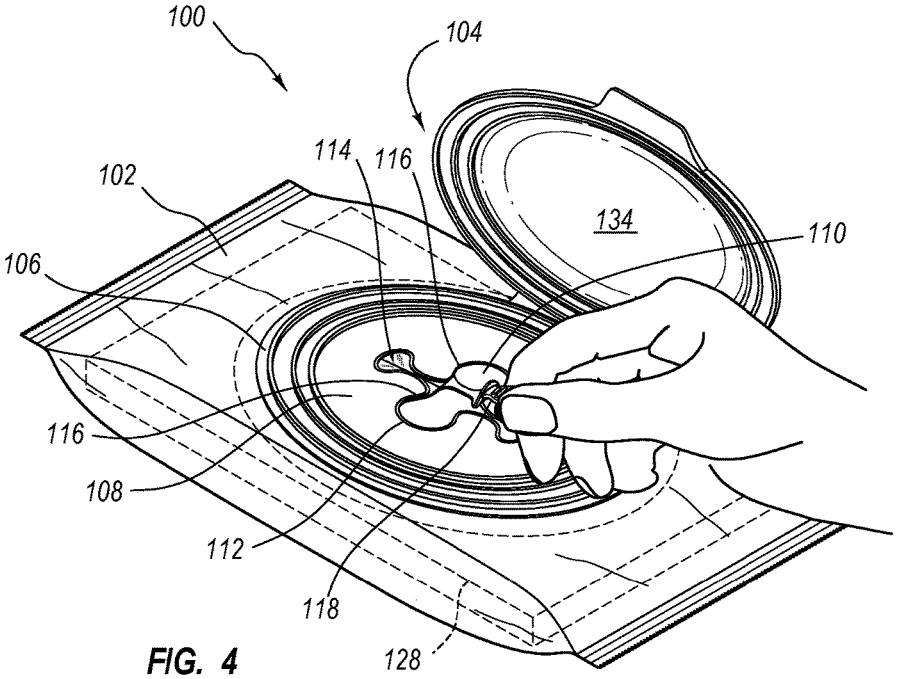
FIG. 4 shows a user beginning to pull the tear-away orifice covering out of the base.

FIG. 3 shows the shape of covering 110, while FIG. 4 shows a user grasping pull-tab 118, beginning removal of covering 110, so as to form orifice 114 in base 108. It will be readily apparent that the tear-away orifice covering 114 may be in the same plane as base 108, being injection molded therewith, all as single piece of plastic material. The perimeter 112 between covering 110 and the remainder of base 108 (at perimeter 112) may be thinned, rouletted, die cut, scored, or the like to cause preferential separation along perimeter 112, as covering 110 is pulled from base 108.

Figure 5:
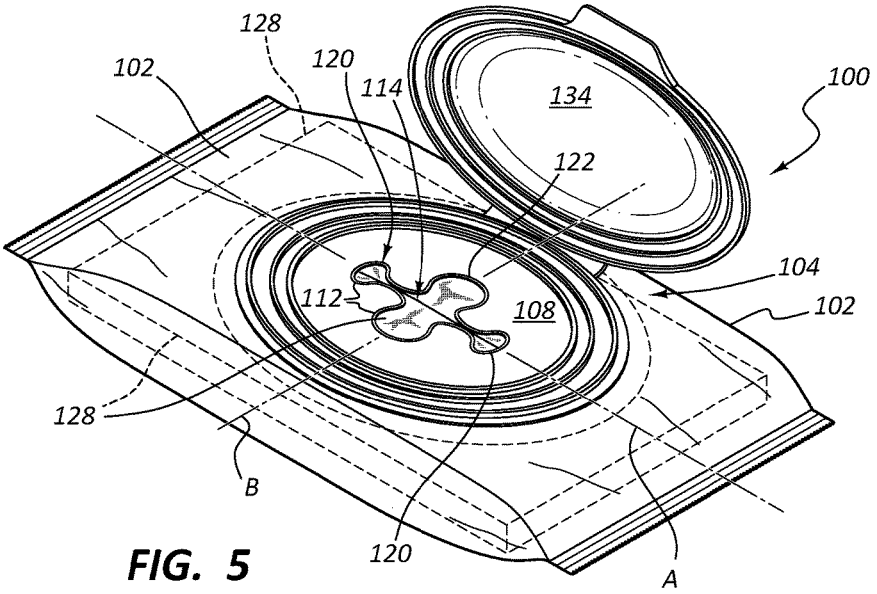
FIG. 5 shows the base with the tear-away orifice covering having been removed.

FIG. 4 (and FIG. 8B) shows removal of covering 114 having progressed to the point where the perimeter pathway 112 begins to have an angle that is greater than 90° relative to the direction of pull P. For example, portion 116 at the transition from portion 120 to portion 122 forms an angle between direction of pull P and portion 116 that is greater than 90°, as illustrated in FIGS. 4 and 8B. FIGS. 4 and 8B clearly show how the pathway 112 may include two portions 116, each of which define angles of greater than 90° relative to the direction of pull P. More or fewer such portions defining an angle greater than 90° relative to the direction of pull may be provided. FIG. 5 shows covering 110 having been fully removed, resulting in formation of orifice 114. Orifice 114 is shown as being centered within recessed elliptical base 108, where portions 122 are disposed over a center (e.g., a pick-point) of the lead wipe of wipes 128.

Central widened portions 122 of orifice 114 advantageously provide easy access for a user's fingers to pick up the lead end of the lead wipe. As shown in FIG. 5 and will be appreciated from FIGS. 8A-8B, the width of portions 122 may be similar to that of a typical user's thumb and index finger, typically employed in grasping the lead wipe of wipes 128. Such dimensions advantageously provide sufficient clearance for a thumb and index finger (or other digits) to easily grasp the leading edge of the lead wipe of wipes 128. The overall height H of portions 122 (see FIG. 8A) may typically be from 3 cm to 8 cm, from 4 cm to 7 cm, or from 5 cm to 6 cm. Such dimensions may similarly accommodate a user's grasping of the leading edge of the lead wipe of wipes 128.

Narrowed portions 120 extending sideways out from central portions 122 may be narrower in height (along axis B) as compared to widened portions 122. Each of portions 120 may include a narrowed neck portion 130, with a relatively wider terminal portion 132 at the ends of portions 120. Portions 120 of orifice 114 may be centrally aligned with the long axis of elliptical base 108, aligned over the leading edge of a lead wipe of wipes 128. The perimeter 112 of portions 120 may aid in contacting the faces of a wipe as it is pulled through orifice 114, particularly narrowed portions 130. Such contact between perimeter 112 and the major faces (top and bottom) of a wipe pulled through orifice 114 aids in reducing any tendency for roping and/or fallbacks, which may otherwise occur. Test results described below provide evidence of a reduction in roping and/or fallbacks as compared to existing orifice geometries. For example, a typical wide elliptical, rectangular, or similar geometry orifice tends to allow for significant roping and/or fallbacks, which is wasteful and frustrating to the user. The presently disclosed orifice geometries can exhibit reduced tendency of roping and/or fallbacks.

As apparent from FIGS. 5 and 8A-8B, orifice 114 and covering 110 may occupy only a relatively small fraction of the overall surface area defined by base 108. For example, in an embodiment, no more than 50%, no more than 40%, or no more than 35% of the surface area defined by base 108 may be occupied by orifice 114 (or covering 110 prior to its removal).

Figure 9A:
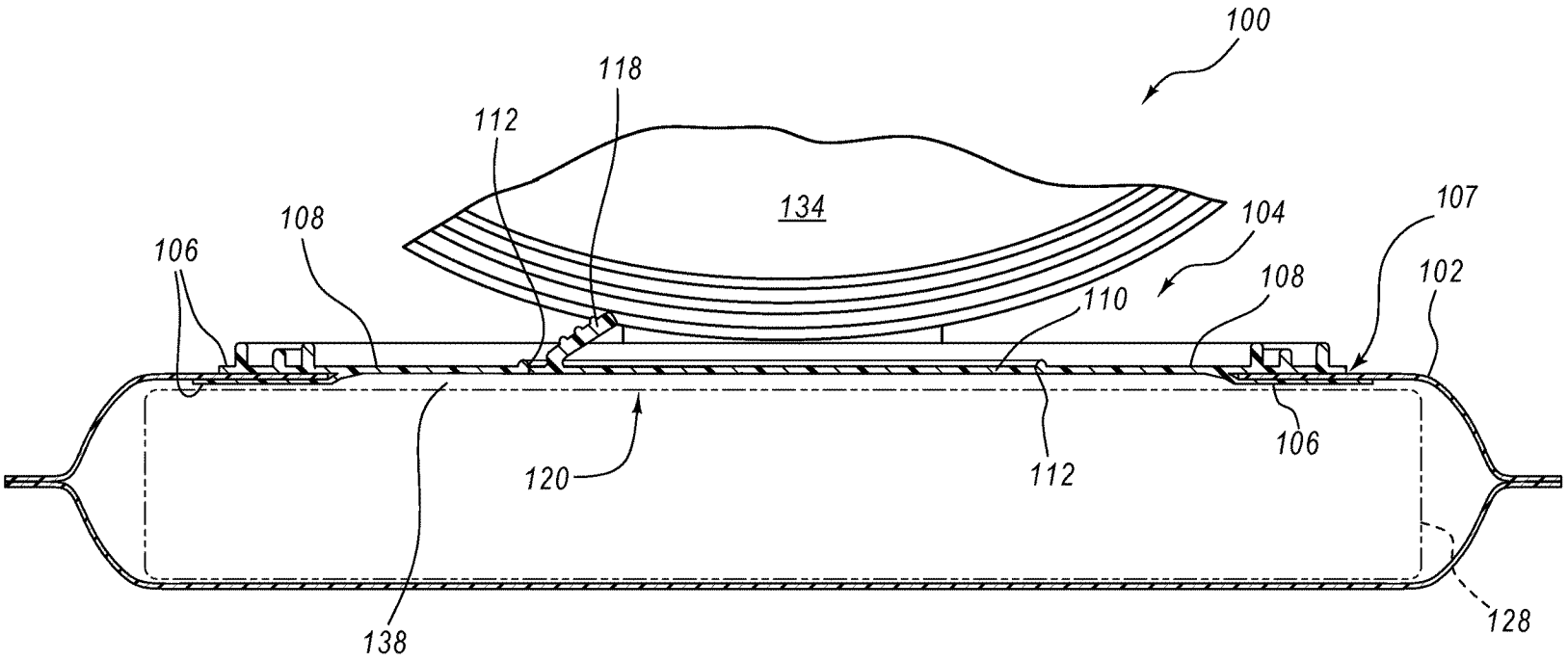
FIG. 9A is a cross-sectional view through the configuration shown in FIG. 8A.
Figure 9B:
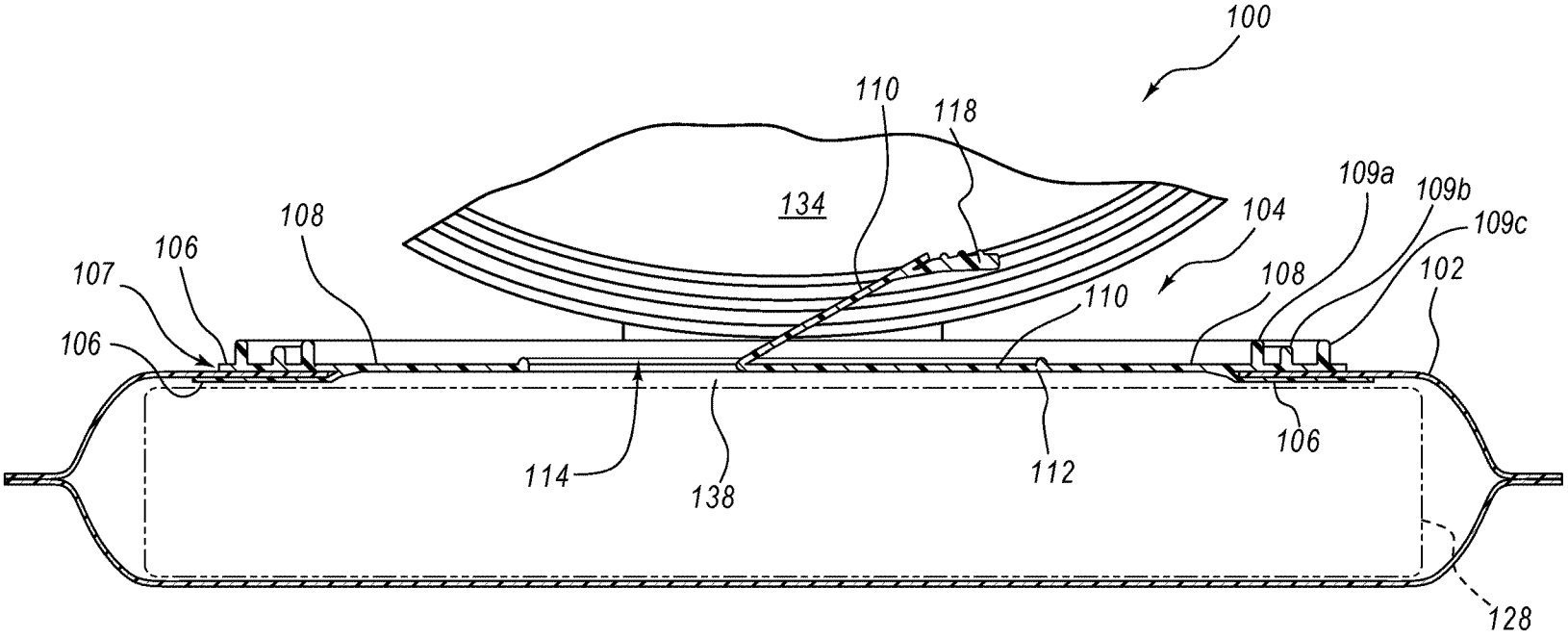
FIG. 9B is a cross-sectional view through the configuration shown in FIG. 8B.

The opening 138 in film material 102 disposed below orifice 114 and covering 110 (e.g., a hole pre-formed during manufacture through the flexible film, material of flexible container body 102) may be at least as large as orifice 114. Such opening 138 is seen in FIGS. 9A-9B. For example, such opening may be an elliptical, rectangular, or other shaped opening having a height at least as great as the height of portions 122, and at least as wide as portions 120. Such an opening may be no larger than the surface area defined by base 108. For example, the opening in flexible container body 102 may have a surface area between that of the base 108 and an ellipse or rectangle bounding the edges of portions 120 and 122, as described above.

Figure 6:
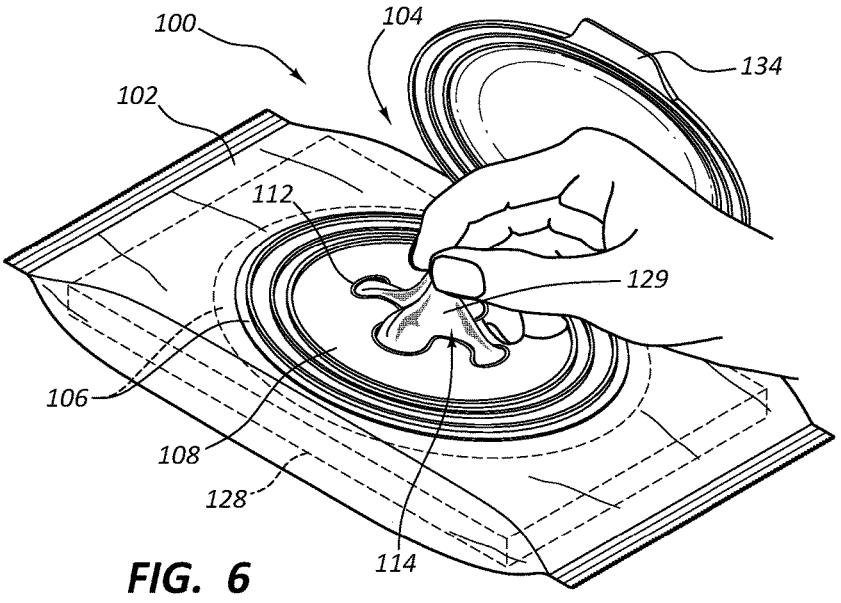
FIG. 6 shows a user beginning to pull a lead end of a lead wipe through the orifice.
Figure 7:
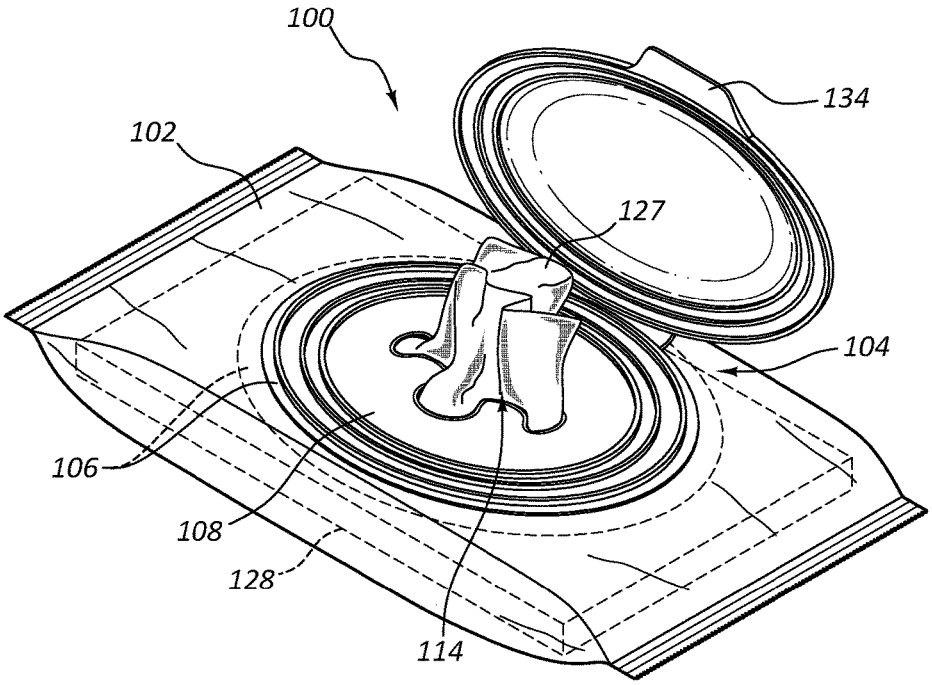
FIG. 7 shows the following wipe threaded through the orifice, once the lead wipe has been pulled from the orifice.

Returning to FIG. 6, a user is illustrated grasping a lead wipe 129 of wipes 128, e.g., using the thumb and index finger, and beginning to pull the lead wipe 129 from the orifice 114 of dispenser 100. FIG. 7 shows dispenser 100 after the lead wipe 129 has been removed, where the following wipe 127 (now itself the lead wipe) of wipes 128 has now threaded itself through orifice 114.

The entirety of closure 104 may be injection molded as a single piece, i.e., it may comprise a single piece of material, so as to require no assembly. Such configurations may be advantageous over other configurations where assembly of various component pieces may be required. For example, the entire wipes dispenser may simply include the flexible container body 102, the closure 104, and wipes 128 contained in flexible container body 102. Such simplicity may simplify manufacture and decrease cost.

Figure 10A:
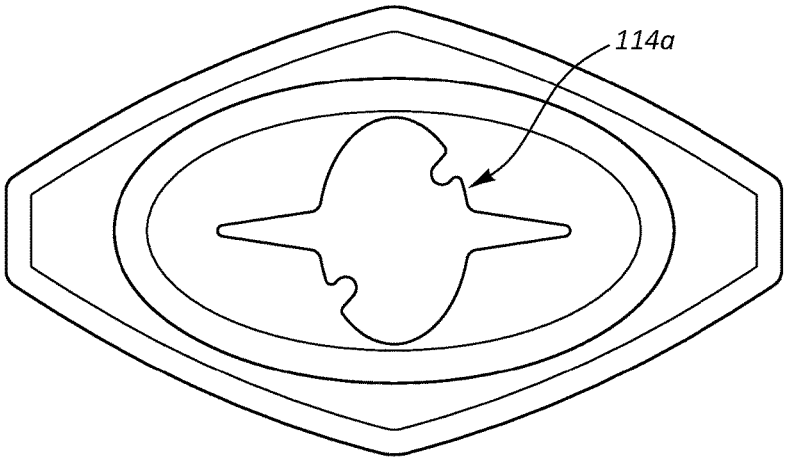
FIGS. 10A and 10B illustrate other orifice geometries according to the present invention.
Figure 10B:
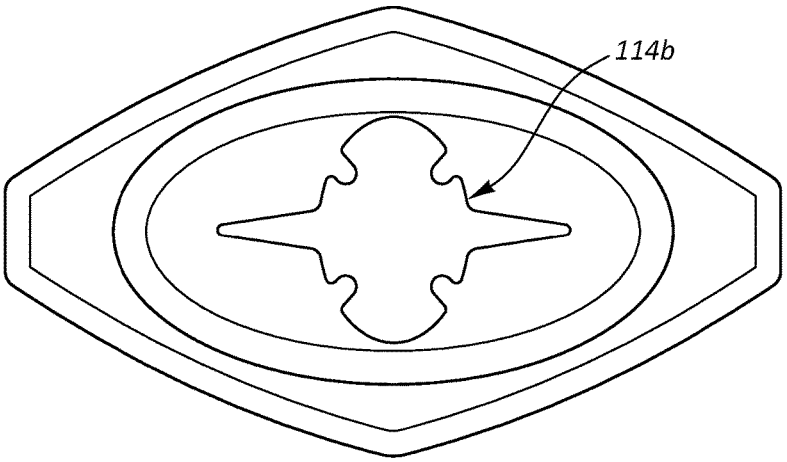

While the orifice geometry seen in FIGS. 5-8B is an example of an orifice geometry that includes a portion that forms an angle that is greater than 90° relative to the direction of pull, it will be appreciated that other geometries can be included in the orifice, which may similarly include such "backwards" angled portions of greater than 90°. By way of non-limiting example, FIGS. 10A and 10B illustrate two such additional orifice geometries 114*a*, and 114*b*, which similarly include at least one portion that forms greater than a 90° angle relative to the direction of pull P.

Figure 11:
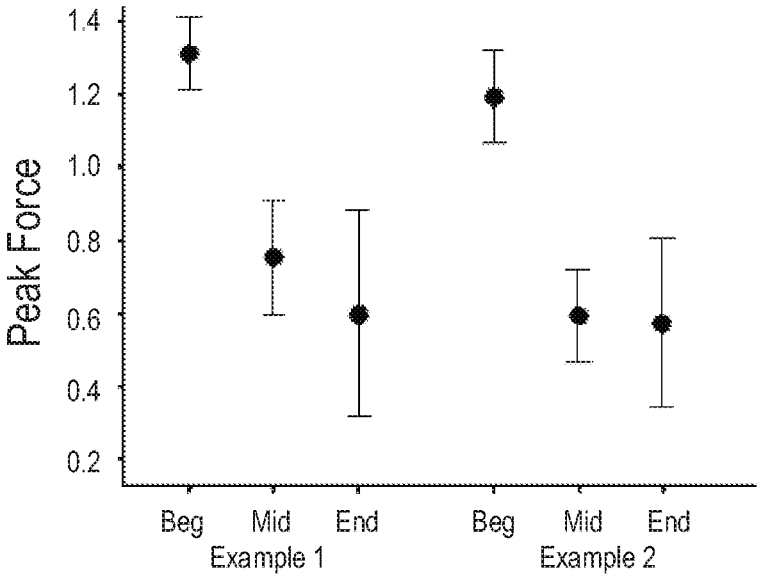
FIG. 11 charts peak or maximum force for dispensing a wipe from various wipes dispensers at the beginning of a package, the middle of a package, and the end of a package (i.e., the last wipes in the package)
Figure 12:
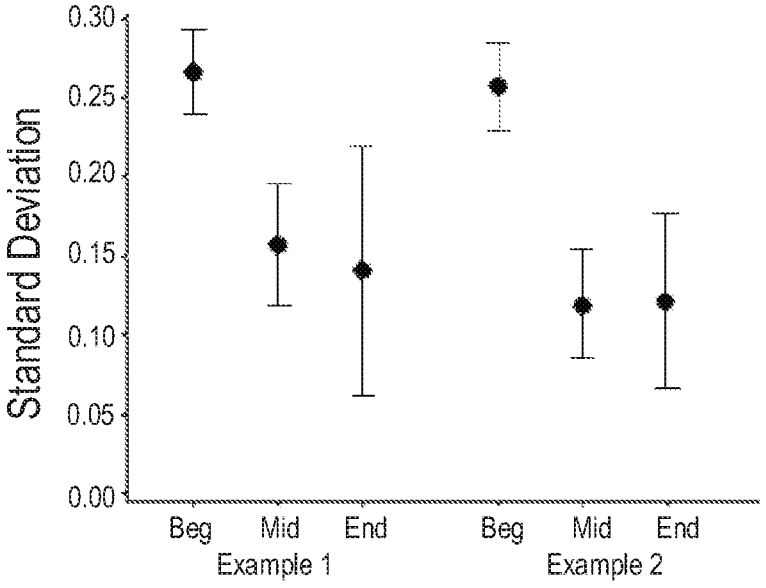
FIG. 12 charts the standard deviation of pull forces during the pull of a single wipe, corresponding to the smoothness of pull, for dispensing wipes from various wipes dispensers at the beginning of the package, the middle of the package, and the end of the package.
Figure 13:
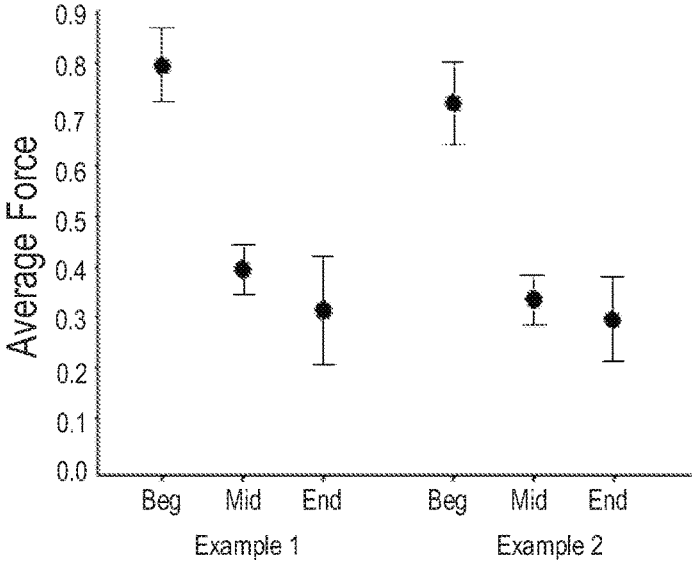
FIG. 13 charts the average force to dispense a wipe from various wipes dispensers at the beginning of the package, the middle of the package, and the end of the package.

The geometry of orifice 114 (and covering 110) including at least one portion (e.g., portion 116) that defines an angle that is greater than 90° relative to the direction of pull P is believed to be at least partially responsible for aiding in the observed reduction in roping and/or fallbacks of the disclosed orifice shapes and sizing as compared to existing "flex pack" orifice configurations. FIGS. 11-17 include various test data for exemplary wipes dispensers according to the present invention. For example, in FIGS. 11-17, "Example 1" refers to the orifice geometry seen in FIG. 10A, while "Example 2" refers to the orifice geometry seen in FIGS. 5-8B. FIGS. 11-13 plot data for peak force, standard deviation, and average force for dispensing wipes from the tested examples. Measurements are plotted for peak force, standard deviation, and average force needed to dispense a wipe from each tested example flex pack wipes dispenser at the beginning, middle and end of each. Forces were measured in lbs. In other words, the "Beg" values shown are for peak force, standard deviation, and average force needed to dispense a wipe at or near the very beginning of the stack of wipes. The "Mid" values are for peak force, standard deviation, and average force needed to dispense a wipe at or near the middle of the stack of wipes (i.e., after about half the pack has already been dispensed). The "End" values shown are for peak force, standard deviation, and average force needed to dispense a wipe at or near the end of the stack of wipes (i.e., for the last wipes in the pack).

Figure 14:
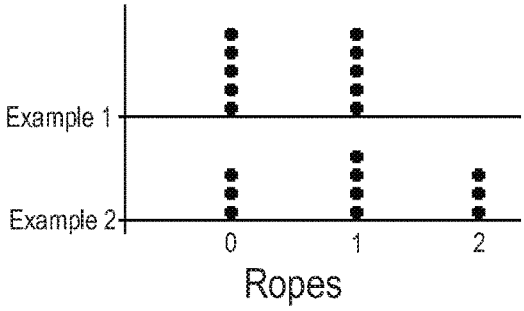
FIG. 14 is a dotplot charting roping results for various tested wipes dispensers.
Figure 15:
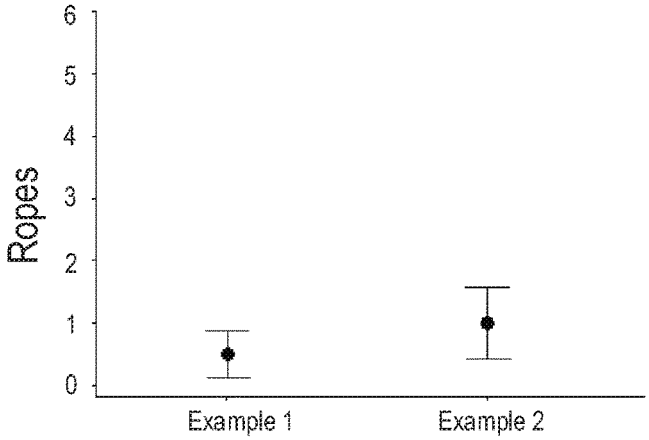
FIG. 15 is an interval plot at a 95% confidence interval (95% CI) for the same roping results shown in FIG. 14.

FIGS. 14-15 show roping data for both Examples 1 (the geometry shown in FIG. 10A) and Example 2 (the geometry shown in FIGS. 5-8B). FIG. 14 shows when dispensing 10 full flex packs of wipes (e.g., about 80 wipes) 5 of the flex packs for Example 1 and 3 of the flex packs for Example 2 had zero roped wipes throughout the entire pack (i.e., when attempting to dispense only a single wipe, only one wipe was dispensed—no following wipes were "roped" therebehind). The other 5 flex packs for Example 1 exhibited a single roping event at some point during dispensing of the wipes in the flex pack (i.e., when attempting to dispense a single wipe, at least two came out). For Example 2, there were 4 flex packs with a single roping event, and there were 3 flex packs (out of the 10) with two roping events (i.e., when attempting to dispense a single wipe, at least two wipes came out). These roping results for both Examples 1 and 2 are far better than exist for current flex pack wipes dispenser configurations. For example, many existing flex pack wipes dispenser configurations result in 3, 4, 5, and even more roping events per flex pack, which is responsible for much waste and user frustration.

Figure 16:
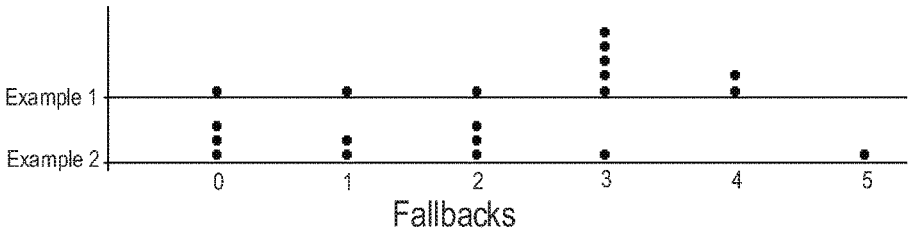
FIG. 16 is a dotplot charting fallback results for various tested wipes dispensers.
Figure 17:
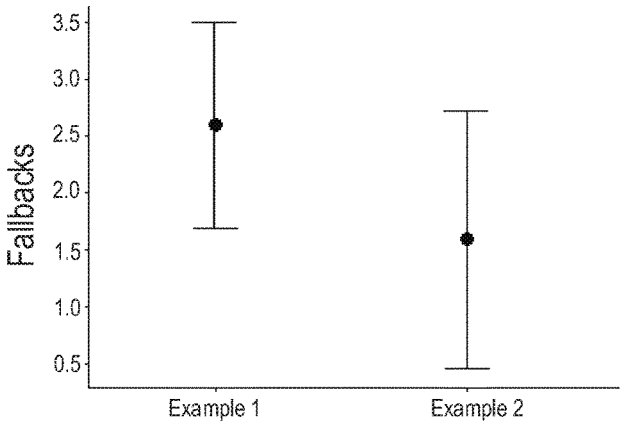
FIG. 17 is an interval plot at a 95% confidence interval (95% CI) for the same fallback results shown in FIG. 16.

FIGS. 16-17 show fallback data for both Examples 1 and 2. FIG. 16 shows when dispensing 10 full flex packs of wipes, 1 of the flex packs for Example 1 and 3 of the flex packs for Example 2 had zero occurrences of fallback throughout the entire pack. One flex pack for Example 1 exhibited a single fallback event at some point during dispensing of the wipes in the flex pack, 1 flex pack for Example 1 exhibited 2 fallback events, 5 flex packs for Example 1 exhibited 3 fallbacks, and 2 flex packs for Example 1 exhibited 4 fallbacks. For Example 2, there were 2 flex packs with a single fallback event, 3 flex packs with 2 fallback events, 1 flex pack with 3 fallbacks, and 1 flex pack with 5 fallbacks. The fallback results for both Examples 1 and 2 are an improvement over many existing flex pack wipes dispenser configurations, which may have an average number of fallbacks per flex pack of about 3 or more.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A wipes dispenser comprising:

(a) a flexible container comprising a flexible container body having an opening through the flexible container body through which wipes may be dispensed, the flexible container body defining an interior region containing a plurality of wipes that are interconnected such that pulling on a lead end of a lead wipe of the plurality of wipes causes a following wipe to also be pulled and follow the lead wipe, the plurality of wipes being in a rectangular shaped stack of wipes; and (b) a closure positioned over the opening of the flexible container body which is configured to allow a user to selectively open and close access to the opening, the closure including:

(i) a perimeter flange which is sealed to the flexible container body, the perimeter flange defining an annular slot within which an edge of the flexible container body is received;

(ii) a base defined within the perimeter flange which initially covers the opening through the flexible container body;

(iii) a tear-away orifice covering defined in the base of the closure, wherein a shape of the tear-away orifice covering includes a tear-away perimeter that follows a pathway that forms an angle that is greater than 90° relative to a direction of pull as the tear-away orifice covering is torn away from the base; and (iv) a hinged cover configured to releasably engage the perimeter flange, wherein the hinged cover is selectively closeable over the base of the closure, wherein the entire closure is formed of a single piece of material.

2. The wipes dispenser of claim 1, wherein the tear-away orifice covering is in a same plane as the base of the closure.

3. The wipes dispenser of claim 1, wherein the pathway forms angles that are greater than 90° at at least two locations relative to the direction of pull as the tear-away orifice covering is torn away from the base.

4. The wipes dispenser of claim 1, wherein the perimeter flange of the closure is sealed to an interior surface of the flexible container body.

5. The wipes dispenser of claim 1, wherein the tear away orifice covering further comprises a pull-tab.

6. The wipes dispenser of claim 1, wherein the perimeter flange includes two walls concentric with each other and disposed about the orifice, and the two walls extend upward from the base.

7. The wipes dispenser of claim 1, wherein a portion of the base in which the tear-away orifice covering is received is located outside of the flexible container body.

8. The wipes dispenser of claim 1, wherein a first portion of the perimeter flange is located inside the flexible container body, and a second portion of the perimeter flange is located outside the flexible container body.

9. The wipes dispenser of claim 1, wherein prior to its removal from the base, the tear-away orifice covering is located outside the flexible container body.

10. A wipes dispenser comprising:

(a) a flexible container comprising a flexible container body having an opening through the flexible container body through which wipes may be dispensed, the flexible container body defining an interior region containing a plurality of wipes that are interconnected such that pulling on a lead end of a lead wipe of the plurality of wipes causes a following wipe to also be pulled and follow the lead wipe, the plurality of wipes being in a rectangular shaped stack of wipes; and (b) a closure positioned over the opening of the flexible container body which is configured to allow a user to selectively open and close access to the opening, the closure including:

(i) a perimeter flange which is sealed to the flexible container body, the perimeter flange defining an annular slot within which an edge of the flexible container body is received;

(ii) a base that is integral with the perimeter flange;

(iii) a tear-away orifice covering defined in the base of the closure and initially covering a portion of the opening through the flexible container body, wherein a shape of the tear-away orifice covering includes a tear-away perimeter that follows a pathway that forms an angle that is greater than 90° relative to a direction of pull as the tear-away orifice covering is torn away from the base, and wherein the base remains in position with respect to the perimeter flange after removal of the tear-away orifice covering; and (iv) a hinged cover configured to releasably engage the perimeter flange, wherein the hinged cover is selectively closeable over the base of the closure, wherein the entire closure is formed of a single piece of material.

* * * * *